US005672082A

United States Patent [19]

Binder

[11] Patent Number: 5,672,082

[45] Date of Patent: Sep. 30, 1997

[54] FLOATING UNDERWATER VIEWING DEVICE

[76] Inventor: Emanuel Binder, 33 Steven Dr., Englewood Cliffs, N.J. 07632

[21] Appl. No.: 672,690

[22] Filed: Jun. 28, 1996

[51] Int. Cl.[6] ..... B63C 11/00

[52] U.S. Cl. ..... 441/135

[58] Field of Search ..... 441/135; 114/66

[56] References Cited

U.S. PATENT DOCUMENTS

| | | | |
|---|---|---|---|
| 4,145,783 | 3/1979 | Rhodes | 9/310 H |
| 4,465,468 | 8/1984 | Deacy | 441/135 |
| 4,553,819 | 11/1985 | Correll | 350/319 |
| 4,691,658 | 9/1987 | New et al. | 114/66 |
| 5,399,111 | 3/1995 | Kobayashi | 441/135 |

FOREIGN PATENT DOCUMENTS

| | | | |
|---|---|---|---|
| 1169837 | 1/1959 | France | 441/135 |

*Primary Examiner*—Stephen Avila
*Attorney, Agent, or Firm*—Stroock & Stroock & Lavan LLP

[57] ABSTRACT

The present invention is a floating underwater viewing device having a column with a first and a second end, and a first viewing window and a second viewing window. The first viewing window is integrally formed with the first end of the column, and the second viewing window is integrally formed with the second end of the column to form a watertight viewing chamber. A first toroidal float and a second toroidal float are disposed about the column. At least one of the first and second toroidal floats is slidably attached to the column.

5 Claims, 2 Drawing Sheets

FIG. 4
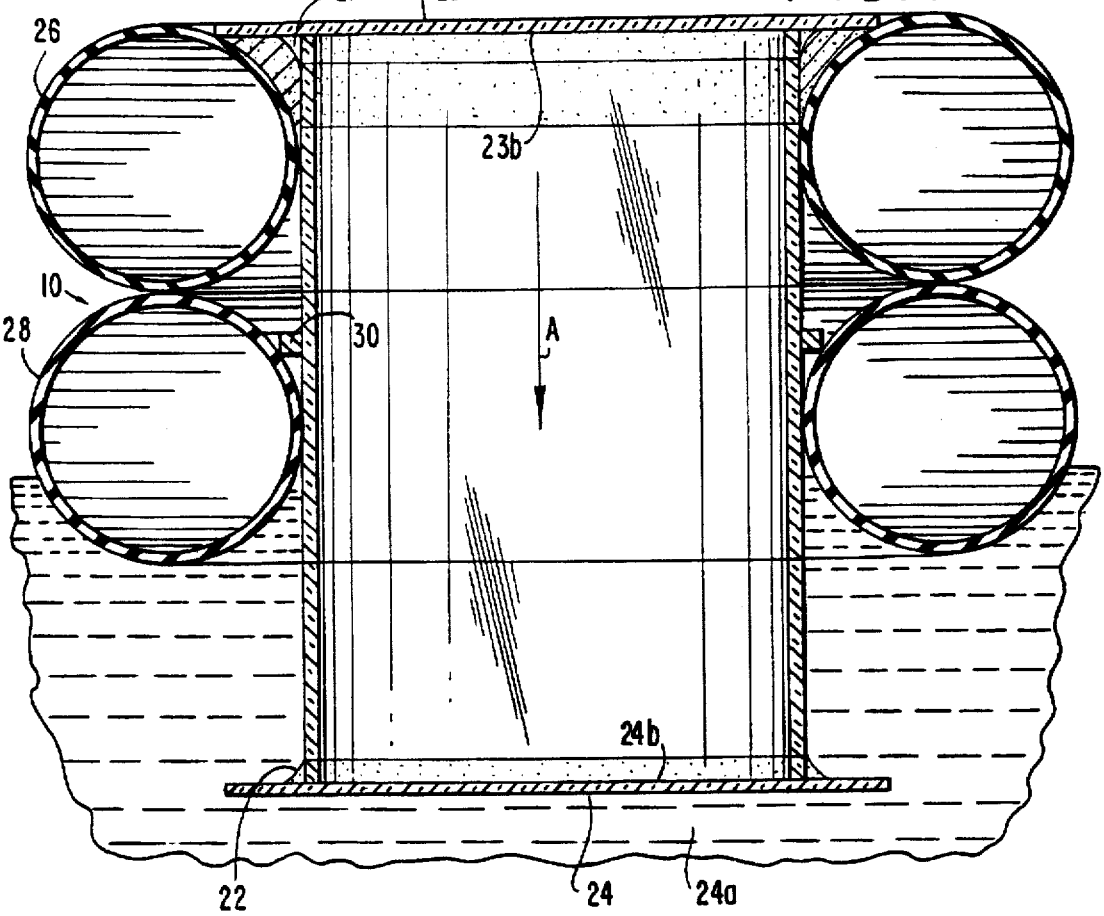
FIG. 5
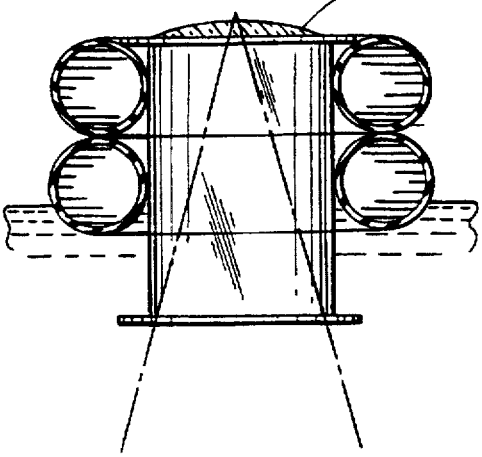
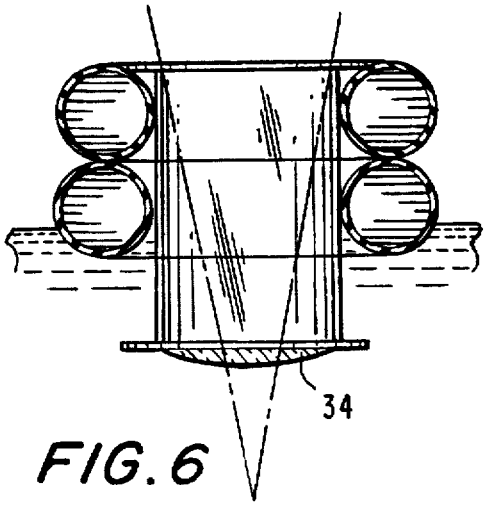
FIG. 6

FLOATING UNDERWATER VIEWING DEVICE

BACKGROUND OF THE INVENTION

The present invention relates to a floating underwater viewing device, and more specifically a device that allows users to view objects located beneath the water without requiring the user to place his or her head in the water.

Typically, when persons wish to view underwater objects, such as coral or fish, they use one of two types of devices. The first category includes devices that allow a number of people to view underwater objects, such as a glass-bottomed excursion boat. This type of device requires that the viewer stand or sit in an upright position to view the objects. It also is prohibitively expensive to use this method more than occasionally.

The second category includes individual viewing devices, such as diving masks. When using a conventional diving mask, wearers often use snorkeling gear to facilitate breathing while they are viewing the underwater objects. This method of viewing underwater objects has a number of disadvantages. People who snorkel expend great physical effort to maintain their position in the water relative to what they are viewing underwater, and do not have a means of resting while engaging in that activity. Thus, persons who are not in good physical condition may not participate in this activity for any length of time. Moreover, people with bridge work or false teeth must remove their teeth prior to engaging in this type of an activity. It therefore becomes quite difficult to retain the snorkeling mouthpiece in the mouth. Finally, many people would prefer not to put their head underwater when enjoying the flora and fauna.

A second device used by individuals is a surfboard or mattress with a viewing window. While this type of device solves many of the foregoing problems, it has the disadvantage of being bulky as the device is typically dimensioned to support the user's entire torso. This is an important deficiency because most people view underwater objects while on vacation, and thus the device will need to be transported. Further, a surfboard of this construction is quite expensive.

For the foregoing reasons, there is a need for an affordable, portable, floating underwater viewing device that supports a user while viewing underwater objects for extended periods of time.

SUMMARY OF THE INVENTION

A floating underwater viewing device has a column with a first and a second end, and a first viewing window and a second viewing window. The first viewing window is integrally formed with the first end of the column, and the second viewing window is integrally formed with the second end of the column to form a watertight viewing chamber. A first toroidal float and a second toroidal float are disposed about the column. At least one of the first and second toroidal floats is slidably attached to the column.

Accordingly, it is an object of the invention to provide an improved underwater viewing device.

Another object of the invention is to provide a viewing device which is easier to grip while providing floating support.

It is another object of the invention is to provide an underwater viewing device that supports the user so that the user may view underwater objects without tiring.

Yet another object of the invention is to provide underwater viewing device that is easily transported and stored.

It is a further object of the invention to provide an underwater viewing device that is cost effective.

Yet another object of the invention is to provide an underwater viewing device that provides the user with more control over what he or she is viewing.

A further object of the invention is to provide an underwater viewing device in which the viewing lens is adjustable relative to the height of the water.

Still other objects and advantages of the invention will in part be obvious and will in part be apparent from the specification.

The invention accordingly comprises an article of manufacture possessing the features, properties, and the relation of elements which will be exemplified in the article hereinafter described. The scope of the invention will be indicated in the claims.

BRIEF DESCRIPTION OF THE DRAWINGS

For a fuller understanding of the invention reference is had to the following description taken in connection with the accompanying drawings, in which:

FIG. 4 is a sectional view of the present invention in a second configuration;

FIG. 5 is a sectional view of the underwater viewing device constructed in accordance with a second embodiment of the present invention;

FIG. 6 is a sectional view of the underwater viewing device constructed in accordance with a third embodiment of the present invention.

DETAILED DESCRIPTION OF THE PREFERRED EMBODIMENTS

Figure 2:
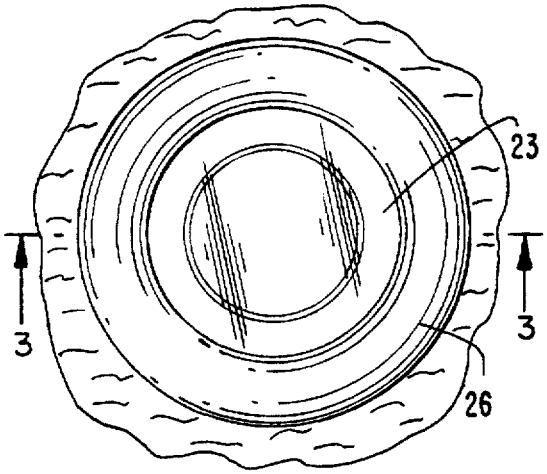
FIG. 2 is a plan view of the underwater viewing device.
Figure 3:
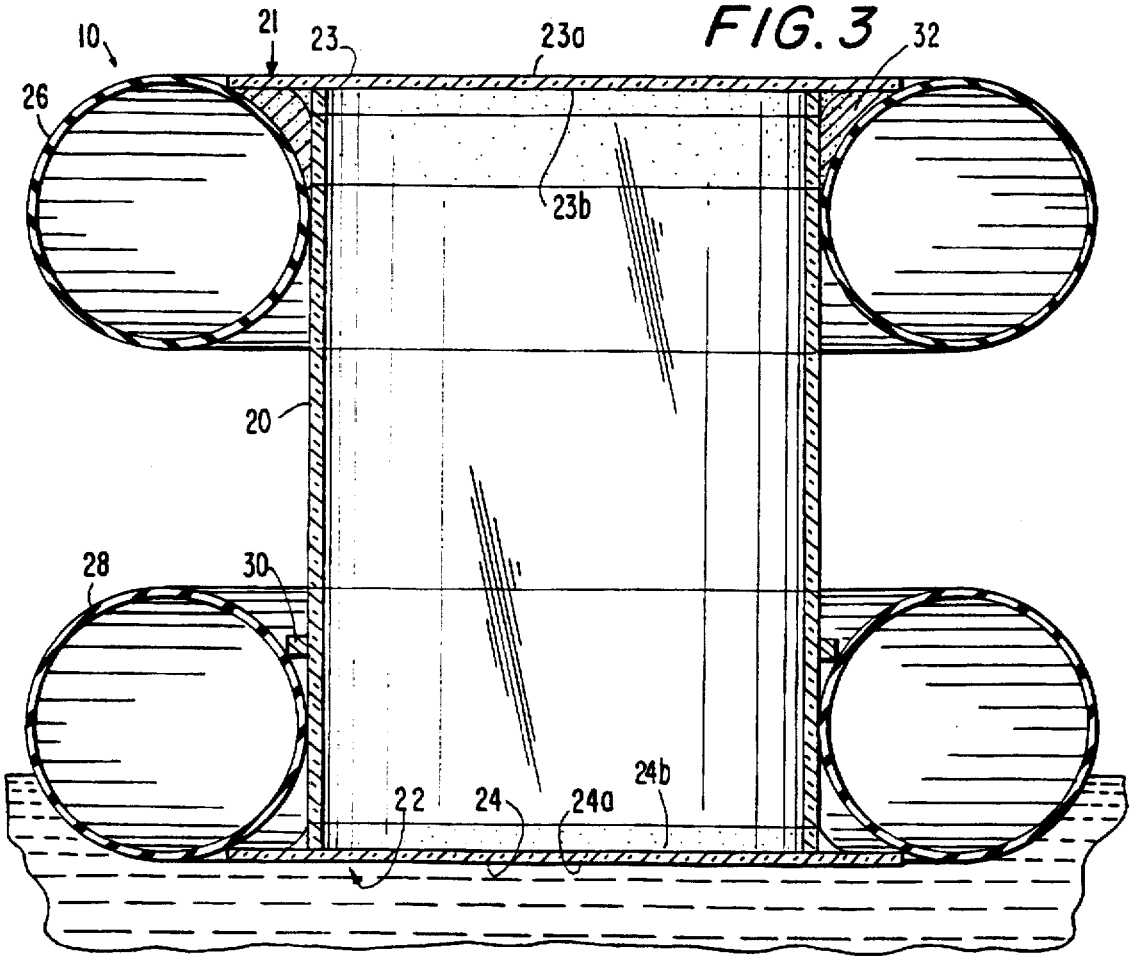
FIG. 3 is a sectional view along line 3—3 of FIG. 2.

Referring now to FIGS. 2 and 3, an underwater viewing device, generally indicated at 10 and constructed in accordance with a preferred embodiment, is disclosed. Underwater viewing device 10 includes a column 20 having a first end 21 and a second end 22. A first viewing window 23 is integrally formed with first end 21 of column 20. First viewing window 23 has a top side **23*a* and a bottom side 23*b*. A second viewing window 24 is integrally formed with second end 22 of column 20. Second viewing window 24 has a top side 24*a* and a bottom side 24*b*. In this manner column 20, first viewing window 23, and second viewing window 24** form a watertight viewing chamber.

The watertight chamber is preferably in the shape of a spool; that is, the diameter of first viewing window 23 and second viewing 24 is preferably larger than the diameter of column 20. Column 20, first viewing window 23, and second viewing window 24 may be made from any suitable transparent material, such as a plastic, that enable the user to view through first viewing window 23 and second viewing window 24 objects beneath the water without distortion. In the preferred embodiment, column 20 is hollow to reduce weight. However, column 20 may also be formed of a solid transparent lightweight material to prevent water from seeping therein. In a preferred embodiment, the dimensions of viewing device 10 should be large enough for a user to wrap an arm around to support a user in a floating, prone position while viewing underwater objects. Thus, it is preferable that the diameter of column 20 be large enough so that a user may grasp column 20 comfortably.

A first toroidal float 26 and a second toroidal float 28 are disposed about column 20. First toroidal float 26 and second toroidal float 28 are preferably rubber tubes, each containing a valve that allows the tubes to be inflated prior to using viewing device 10. In the preferred embodiment, first toroidal float 26 is affixed to bottom side 23*b* of first viewing window 23 and column 20 by a bonding material 32, preferably a lightweight glue or rubber. Second toroidal float 28 is slidably mounted about column 20. Second toroidal float 28 is prevented from sliding off of column 20 by the second viewing window 24, the diameter of which is larger than the inner diameter of second toroidal float 28.

Figure 1:
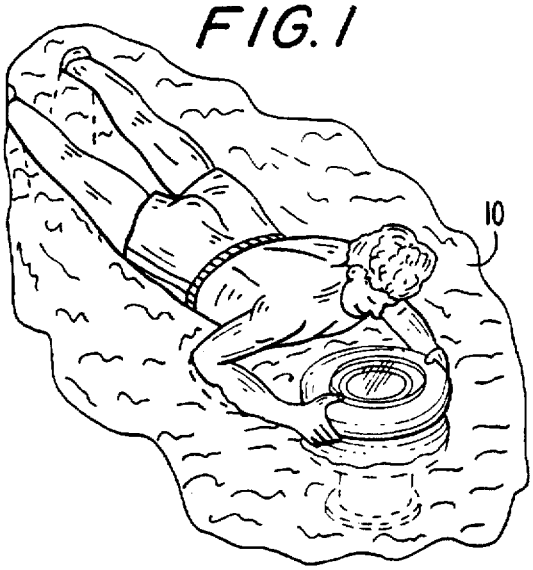
FIG. 1 is a perspective view of a user employing the underwater viewing device constructed in accordance with the present invention.

FIG. 1 depicts the user in the prone position, grasping viewing device 10 about first toroidal float 26. The user may also grip viewing device 10 around column 20 at a position between first toroidal float 26 and second toroidal float 28. By moving sleeve 30 along column 20, the user can adjust the position of second toroidal float 28 along column 20. In this manner, the user may determine the height at which viewing device 10 sets in the water. That is, by adjusting the position of second toroidal float 28 toward the fixed position of first toroidal 26, in the direction opposite to that depicted by Arrow A of FIG. 4, viewing device 10 will float lower in the water. Conversely, by sliding second toroidal float 28 away from the fixed position of first toroidal 26, in the direction shown in arrow A of FIG. 4, viewing device 10 will float at a lower position in the water. Further, when the user grasps viewing device 10 about column 20, the user may make viewing device 10 easier to grip by sliding second toroidal float 28 to a position just below first toroidal float 26 such that the user's arms fit snugly between first toroidal float 26 and second toroidal float 28 making it possible to swim with the device.

Because the viewing device 10 supports the user thereby allowing the user to rest, the activity is less tiring compared to snorkeling. Furthermore, the stress on the body is reduced as there is no need for a snorkel and there is no need to put one's head in the water. Finally, the user is provided with more control over what he or she is viewing because only a small part of the underwater view is blocked by viewing device 10 and maneuvering viewing device 10 is accomplished by natural swimming movements. The user can utilize his or her whole body to maneuver viewing device 10, rather than paddle with their arms as required with prior art mattresses and the like. In addition, because viewing device 10 has a manageable construction, the user may easily adjust his or her position relative to viewing device 10 to gain a better view of the underwater object. Other floating viewing devices are cumbersome thus making it difficult for the user to position him or herself over the desired location. It is also contemplated that a bungee cord or the like can be affixed between viewing device 10 and the user to prevent separation between the two. Furthermore, the bungee cord may form a removable sleeve 30 shown in phantom to prevent sliding second toroidal float 28 from moving towards first toroidal float 26 beyond a predetermined position. As a result, the height of column 20 can be adjusted relative to the water to maximize ease of use, comfort, and viewing for the user.

In a second embodiment, shown in FIG. 5, a wide-angle lens is affixed to first viewing window 23. In a third embodiment, shown in FIG. 6, a magnifying lens is affixed to second viewing window 24. In this manner, the field of view may be more focused or magnified. It is also contemplated that the user could affix a prescription lens to first viewing window 23 or second viewing window 24. Furthermore, window 24 could be smaller in diameter than window 23 to focus the field of view.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An underwater viewing device comprising:

a column having a first end and a second end, said column consisting of a substantially transparent material;

a first viewing window and second viewing window, said first viewing window and said second viewing window having a top side and a bottom side, said first viewing window and said second viewing window consisting of a substantially transparent material, and a diameter larger than the diameter of said column, said first viewing window being integrally formed with said first end of said column, and said second viewing window being integrally formed with said second end of said column, thereby forming a watertight viewing chamber; and a first toroidal float and second toroidal float disposed about said column, said first toroidal float being attached to said column at said first end of said column, and said second toroidal float being slidably mounted on said column; and at least one sleeve disposed about said column such that said at least one sleeve may be positioned to prevent said second toroidal float from sliding along said column.

2. The underwater viewing device of claim 1, wherein said first toroidal float and said second toroidal float comprise inflatable tubes.

3. The underwater viewing device of claim 1, wherein at least one of said first viewing window and said second viewing window is a magnifying lens.

4. The underwater viewing device of claim 1, wherein at least one of said first viewing window and said second viewing window is a wide-angle lens.

5. The underwater viewing device of claim 1, wherein at least one of said first viewing window and said second viewing window is a prescription lens.

* * * * *